US009328441B2

(12) United States Patent
Nakata et al.

(10) Patent No.: US 9,328,441 B2
(45) Date of Patent: May 3, 2016

(54) SUPPORT GUIDE FOR MAKING DECK SEAMS AND FRENCH SEAMS WITH SLIDE FASTENER

(71) Applicant: YKK CORPORATION, Tokyo (JP)

(72) Inventors: Yoshifumi Nakata, Marietta, GA (US); Richard James Lorenz, Jr., Plymouth, MI (US); Tomonari Yoshida, Tokyo (JP); Tetsuya Yoshino, Novi, MI (US); Thanh Phat Nguyen, Macomb, MI (US)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 14/306,455

(22) Filed: Jun. 17, 2014

(65) Prior Publication Data

US 2015/0361605 A1 Dec. 17, 2015

(51) Int. Cl.

| | |
|---|---|
| ***D05B 35/06*** | (2006.01) |
| ***D05B 3/12*** | (2006.01) |
| ***D05B 1/20*** | (2006.01) |

(52) U.S. Cl.

CPC ..... *D05B 35/064* (2013.01); *D05B 1/20* (2013.01); *D05B 3/12* (2013.01)

(58) Field of Classification Search

CPC ..... D05B 3/12; D05B 3/18; D05B 3/20; D05B 3/22; D05B 35/06; D05B 35/064; A44B 19/00

USPC ..... 112/152, 470.33, 475.06, 475.16

See application file for complete search history.

(56) References Cited

U.S. PATENT DOCUMENTS

| | | | | |
|---|---|---|---|---|
| 2,131,250 | A * | 9/1938 | De Voe | 112/136 |
| 2,151,346 | A * | 3/1939 | Devoe | 112/105 |
| 2,329,991 | A | 9/1943 | Kellum | |
| 2,891,495 | A | 6/1959 | Porter | |
| 3,016,028 | A * | 1/1962 | Schreck et al. | 112/105 |
| 3,608,506 | A | 9/1971 | Glindmeyer | |
| 3,633,528 | A * | 1/1972 | Frohlich et al. | 29/410 |
| 3,858,538 | A | 1/1975 | Van Amburg | |
| 4,658,740 | A | 4/1987 | Goldbeck et al. | |
| 4,996,933 | A * | 3/1991 | Boser | 112/475.06 |
| 5,114,057 | A | 5/1992 | Ishikawa | |
| 5,168,785 | A | 12/1992 | Yunoki | |
| 5,208,970 | A | 5/1993 | Ishikawa | |
| 6,125,666 | A | 10/2000 | Matsuda | |
| 6,742,226 | B2 | 6/2004 | Matsuda et al. | |
| 6,780,264 | B2 | 8/2004 | Nakata et al. | |

(Continued)

FOREIGN PATENT DOCUMENTS

| | | |
|---|---|---|
| EP | 1428920 | 6/2004 |
| JP | U-S56-26086 | 3/1981 |

(Continued)

OTHER PUBLICATIONS

Duerkopp Adler; Model 868 Instruction Manual 0791 868751, dated Mar. 2011, 90 pgs.

(Continued)

*Primary Examiner* — Ismael Izaguirre

(74) *Attorney, Agent, or Firm* — Taylor English Duma LLP

(57) ABSTRACT

Disclosed is a support guide for sewing a decorative topstitch on a seam with a slide fastener, the support guide including a first top surface; and a second top surface, the first top surface coplanar with the second top surface and spaced apart from the second top surface by a distance sized to accept the slide fastener.

20 Claims, 12 Drawing Sheets

(56) References Cited

U.S. PATENT DOCUMENTS

| | | | | |
|---|---|---|---|---|
| 6,792,883 | B2 * | 9/2004 | Ashton | 112/475.01 |
| 7,188,395 | B2 | 3/2007 | Kondo et al. | |
| 7,426,772 | B2 | 9/2008 | Himi et al. | |
| 7,857,383 | B2 | 12/2010 | Nguyen | |
| 2008/0222855 | A1 | 9/2008 | Takani et al. | |
| 2013/0092067 | A1 | 4/2013 | Sawada et al. | |

FOREIGN PATENT DOCUMENTS

| | | |
|---|---|---|
| JP | U-S56-125180 | 9/1981 |
| JP | Y-S57-19098 | 4/1982 |
| JP | U-S62-204578 | 10/1989 |
| JP | Y-H03-54701 | 12/1991 |
| JP | A-H07-246292 | 9/1995 |

OTHER PUBLICATIONS

Duerkopp Adler; Model 868 Leaflet 9099 100868 01, dated Jun. 2009, 6 pgs.
Duerkopp Adler; Model 868 Parts List 0791 868801, dated Oct. 2013, 91 pgs.
Duerkopp Adler; Model 868 Service Instructions 0791 868641, dated Jan. 2009, 66 pgs.
Duerkopp Adler; Model 888 Service Instructions 0791 888651 , dated May 2012, 50 pgs.
Juki; "Juki Model Series 1710, 1760", located at http://www.juki.co.jp/industrial_e/products_e/leather_e/cat92/plc17107_1710_plc17607_1 . . . >, accessed on Apr. 22, 2014, 2 pgs.
Juki; Model SPUR TL-30 Instruction Manual 40096725-1, Copyright 2010-2011, located at <http://www.juki.co.jp/household_ja/pdf/TL-30_manual.pdf>, 24 pgs.
justanswer.com; "Seat Construction Exploded View", located at <http://ww2.justanswer.com/uploads/Speedytimzalez/2010-10-01_233930_rfqrqrfqrq.gif>, accessed on Apr. 24, 2014, 1 pg.
Website entitled: "Structure of a Zipper", located at <http://kokoro.umwblogs.org/files/2009/02/zipper1.jpg, acccessed on May 2, 2014, 1 pg.
YKK Corporation of America; "YKK Automotive, Seat Assembly with Invisible Zipper", located at <http://ykkamerica.com/auto/zipper.htm, accessed on Apr. 22, 2014, 1 pg.
YKK Corporation; Extended European search report for serial No. 15172290.7, mailed Oct. 12, 2015, 7 pgs.

* cited by examiner

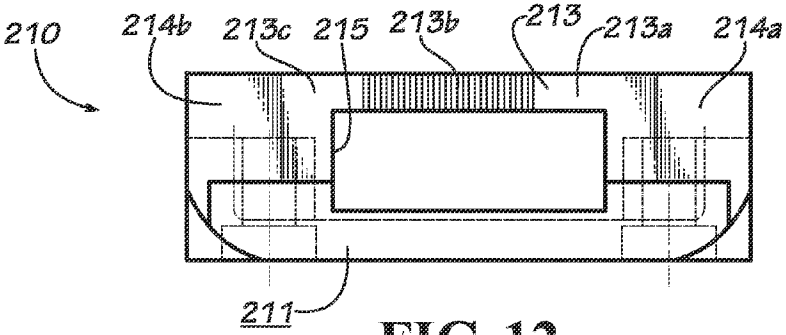
FIG. 12
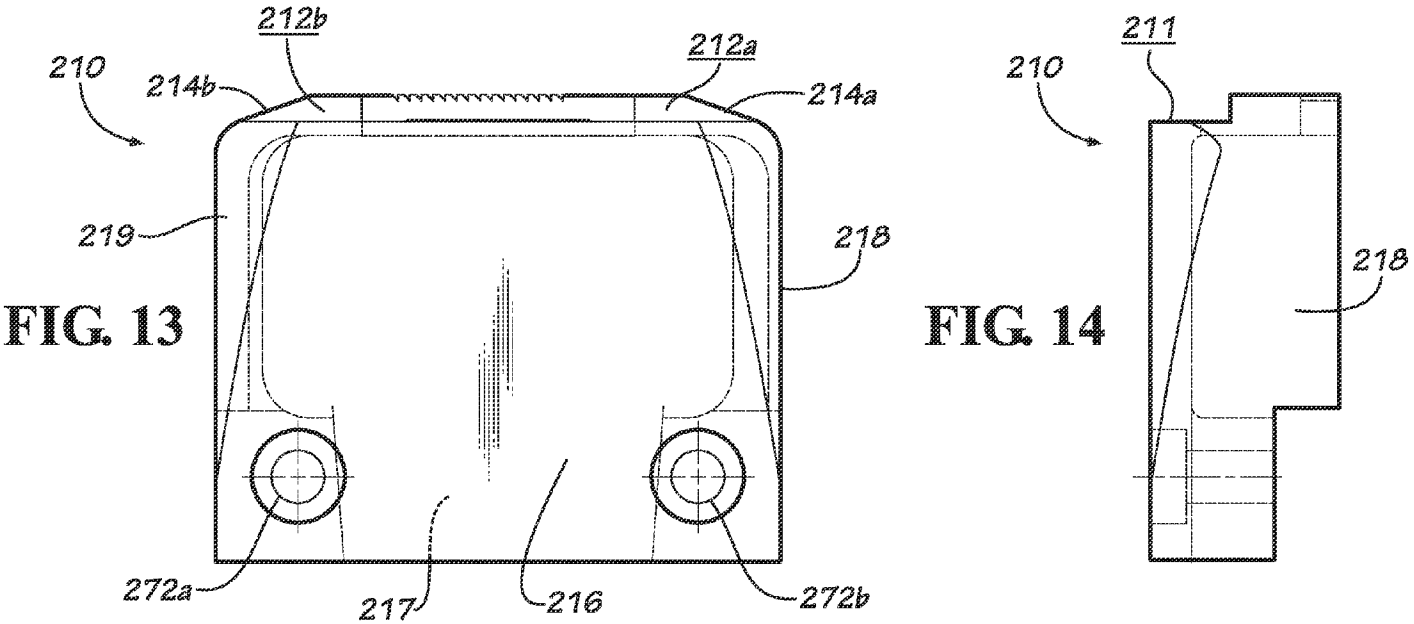
FIG. 14
FIG. 13

SUPPORT GUIDE FOR MAKING DECK SEAMS AND FRENCH SEAMS WITH SLIDE FASTENER

TECHNICAL FIELD

The present invention relates generally to sewing and, in particular, to sewing items with slide fasteners.

BACKGROUND

Seams are sometimes either required or desirable in a sewn garment, in sewn upholstery, and in other sewn articles. Seams include joint seams, deck seams, and French seams and can serve both a utilitarian or decorative purpose. Deck seams and French seams are joint seams with additional decorative topstitching. While the stitching that makes up a joint seam is often hidden on the inside or back of a sewn article, decorative topstitching is stitching on a sewn article that is visible from the top or outside of that article. "Decorative," however, does not mean that the stitching has no utilitarian purpose. In various embodiments, decorative topstitching results in a stronger or otherwise more desirable seam. The seams can be visible or hidden, and the material used to hold the seams together—often but not always sewing thread—can itself be visible or hidden, highlighted, or camouflaged through the use of fabric and thread color combinations, for example.

As consumer requirements and governmental and other regulations change over time, causing new utilitarian or decorative features to become popular or even mandatory, there are opportunities to use new sewing technologies that heretofore have not been developed. One example of a changing consumer requirement or trend is the increased popularity of heating and/or cooling systems in automobile seating—systems designed to keep drivers and/or passengers more comfortable. One example of a changing government or industry regulation is the increasingly stringent automobile safety standards that cause some manufacturers to install air bags directly on or inside the seat and on or inside the surrounding structure of their vehicles. In many cases, installing heaters, coolers, supplemental restraint systems (i.e. air bags), motors, gears, relays, wiring, connectors and other mechanical and electronic components inside automobile seats requires the use of automobile seat covers that permit access inside the seat cover for repair or replacement of these and other internal components.

Fasteners containing "zipper" elements, also known as "slide fasteners," can be used in seat cover design to provide access inside the seat. It can be desirable to combine the decorative look of the aforementioned deck seam or French seam with the performance and convenience of a slide fastener to connect parts of an automobile seat cover and conceal the slide fastener behind the seam. However, combining a slide fastener with decorative topstitching like used in a deck seam or a French seam can be difficult because the close proximity of the slide fastener to the seam makes it difficult to move the seam through a sewing machine.

SUMMARY

Disclosed is a support guide for sewing a decorative topstitch on a seam with a slide fastener, the support guide including a first top surface; and a second top surface, the first top surface coplanar with the second top surface and spaced apart from the second top surface by a distance sized to accept the slide fastener.

Also disclosed is a sewing system for sewing a decorative topstitch on a seam with a slide fastener, the system including a sewing machine; and a support guide, the support guide including a first top surface and a second top surface, the first top surface coplanar with the second top surface and spaced apart from the second top surface by a distance sized to accept the slide fastener.

Also disclosed is a method of sewing a decorative topstitch on a seam with a slide fastener, the slide fastener including a first joining part including a first set of connecting elements and a second joining part including a second set of connecting elements, the method including affixing a first sewing panel to the slide fastener by affixing the first joining part of the slide fastener to a first joining edge of the first sewing panel; affixing a second sewing panel to the slide fastener by affixing the second joining part of the slide fastener to a second joining edge of the second sewing panel; connecting the first set of connecting elements to the second set of connecting elements thereby forming a joint seam; placing the joint seam with the slide fastener face down on a support guide mounted on a sewing machine to align the slide fastener in a vertical position and in a horizontal position, a bottom leading edge of the first sewing panel and a bottom leading edge of the second sewing panel aligned with the first top surface and second top surface; placing the joint seam with slide fastener into a space between the first top surface and the second top surface to align the joint seam with a needle; and sewing a decorative topstitch on at least one side of the joint seam through a one of the first sewing panel or the second sewing panel.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

FIG. 12 is a top view of a grooved throat plate of the support guide of FIG. 8.

FIG. 13 is a side view of the grooved throat plate of FIG. 12.

FIG. 14 is a front view of the grooved throat plate of FIG. 12.

DETAILED DESCRIPTION

Disclosed is a support guide system and associated methods, systems, devices, and various apparatus for combining two panels of sewable material with a deck seam or a French seam containing a slide fastener. It would be understood by one of skill in the art that the disclosed system is described in but a few exemplary embodiments among many. No particular terminology or description should be considered limiting on the disclosure or the scope of any claims issuing therefrom.

Applications of this disclosure technology include but are not limited to consumer and commercial vehicle seat covers and other vehicle upholstery (headrest covers, for one example among others), furniture upholstery, pillows, and cushions. References to the application of the disclosed technology in cars and automobiles can be considered to apply also to any vehicle, motorized or not, that would or could require upholstery or any kind of cover, including but not limited to vehicles for use on land, in water, in the earth's atmosphere, and/or in outer space. For one example among others, the disclosed technology could be included in an aircraft seat cover or in a protective cover for a boat as much as in an automobile seat cover. The disclosed can be adapted for the manufacture of these and still other products that could benefit from the use of a sewable cover which at any point may need to be removed or opened.

Figure 1:
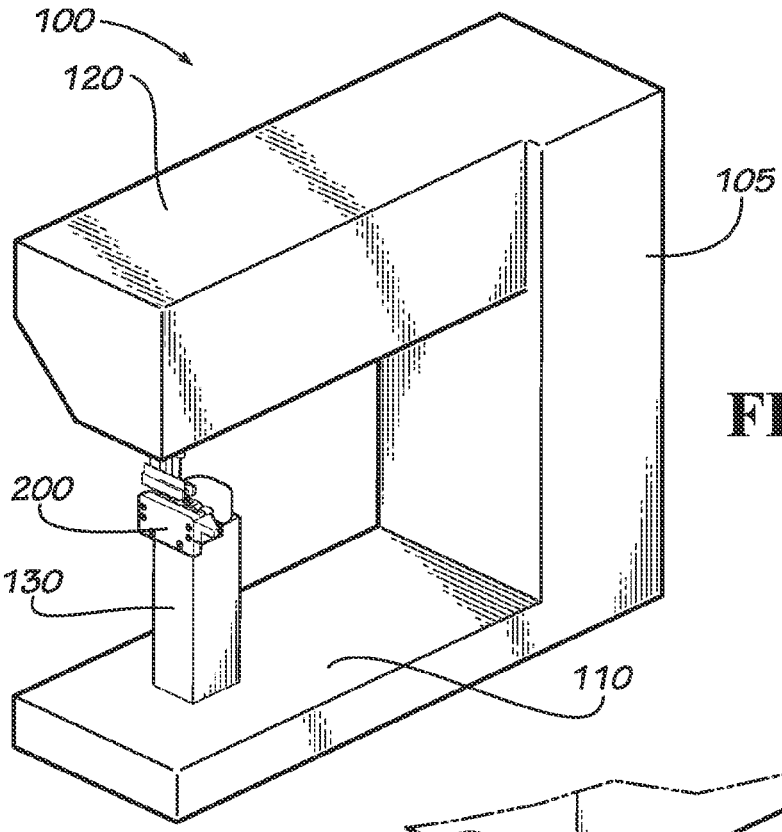
FIG. 1 is a perspective view of an embodiment of a support guide assembly mounted on a sewing machine.

Disclosed in FIG. 1 is a perspective view of a first embodiment of a system for making a deck seam 2500 (shown in FIG. 25) or a French seam 2600 (shown in FIG. 26) with a slide fastener along at least a portion of the seam. Shown is a sewing system 100 containing a sewing machine 105 and a support guide assembly 200. Sewing machine 105 includes a base 110, an arm 120, and a post 130. The post 130 is typically oriented in a substantially vertical position, which will be substantially perpendicular to base 110. The sewing machine 105 shown in the current embodiment is sometimes referred to as a post bed machine or a post-bed lockstitch machine because of the presence of post 130, and the terms "post" and "post bed" are considered interchangeable with each other. "Bed" is commonly used to describe that part of the sewing machine supporting the material being sewn, typically directly under the sewing needle or needles.

An example of a sewing machine 105 that accommodates the support guide assembly 200 of the current embodiment is DÜRKOPP ADLER Model No. 868-190020 by Dürkopp Adler AG of Bielefeld Germany. This particular model machine is described by the manufacturer as a "single needle lockstitch post bed machine with right-handed post bed." Per the manufacturer, an example application of this machine is "topstitching operations in narrow radii in the production of car seat covers." In various embodiments, DÜRKOPP ADLER Model No. 767 is used, and other sewing machines are used in other various embodiments. While the sewing machine 105 modified in the current embodiment is a machine having only one needle, this disclosure contemplates the use of twin needle machines in other embodiments. According to the manufacturer of the machine, a twin needle lockstitch post bed machine with left-handed post bed (example machine DÜRKOPP ADLER Model No. 868-390322 by Dürkopp Adler AG) can be used for "topstitching operations in narrow radii in the production of headrests" and a twin needle lockstitch post bed machine with what could be described as a centered post bed (example machine DÜRKOPP ADLER Model No. 868-290322 by Dürkopp Adler AG) can be used for "topstitching of furniture leather" because of its ability to ensure "tight stitch formation and constant seam margins by means of sewing equipment with compensating foot and presser foot with integrated seam center guide."

Other models by the aforementioned manufacturer and by any number of other manufacturers (for example, JUKI Model PLC-1710 series and Model PLC-1760 series machines by Juki Corporation of Tokyo, Japan) may be used in the practical implementation of the current disclosure. Each of these particular industrial sewing machine models utilize a "walking foot" feed design and are especially suited for the thicker materials commonly used in the manufacture of vehicle seat covers and other upholstery and covers. The current disclosure also includes the successful use of other sewing machines, both industrial and residential, in various other embodiments having a roller foot or other feed methods to feed the material being sewn through the sewing machine. These sewing machine models are provided simply as illustrative examples and are not to be interpreted as limiting of the present disclosure.

In discussing the embodiments disclosed herein, terms such as "left," "right," "front," "rear," "top," "bottom," "outside," "inside," "exterior" and "interior" are used to describe the position and/or orientation of various parts or views. "Front" is considered that side of the sewing machine 105 (or that corresponding side of the sewing machine of various other embodiments) which faces the operator of the sewing machine 105 if the operator is feeding material into the sewing machine 105 as intended by the manufacturer of the sewing machine 105, or "front" can be considered what is seen from that same operator position. "Left" corresponds to that which is on the left or seen from the left of an operator of the sewing machine 105 in the same position as described above. "Top" corresponds to that which is seen from above the sewing machine 105 or whatever item is being viewed. "Outside" corresponds to that which is visible by the operator or end user, at least relative to the operator or the end user. In the case of a sewn automobile seat cover, for example, an "outside" surface would mean the visible surface of the seat cover on which a driver or passenger would sit while riding in the vehicle, whereas an "inside" surface would be hidden and facing whatever internal components are present. "Exterior" can be used interchangeably with "outside," and "interior" can be used interchangeably with "inside."

Sewing system 100 is suitable for making deck seams or French seams in combination with a slide fastener. The sewing panels are made of woven fabric in various embodiments. In other embodiments, the sewing panels are made of leather. In yet other embodiments, the sewing panels are made out of any flexible material that can be penetrated with a sewing needle, the range of flexible materials including but not limited to natural fabrics like cotton and leather and various polymeric materials including simulated leather, vinyl, and polyester.

Figure 2:
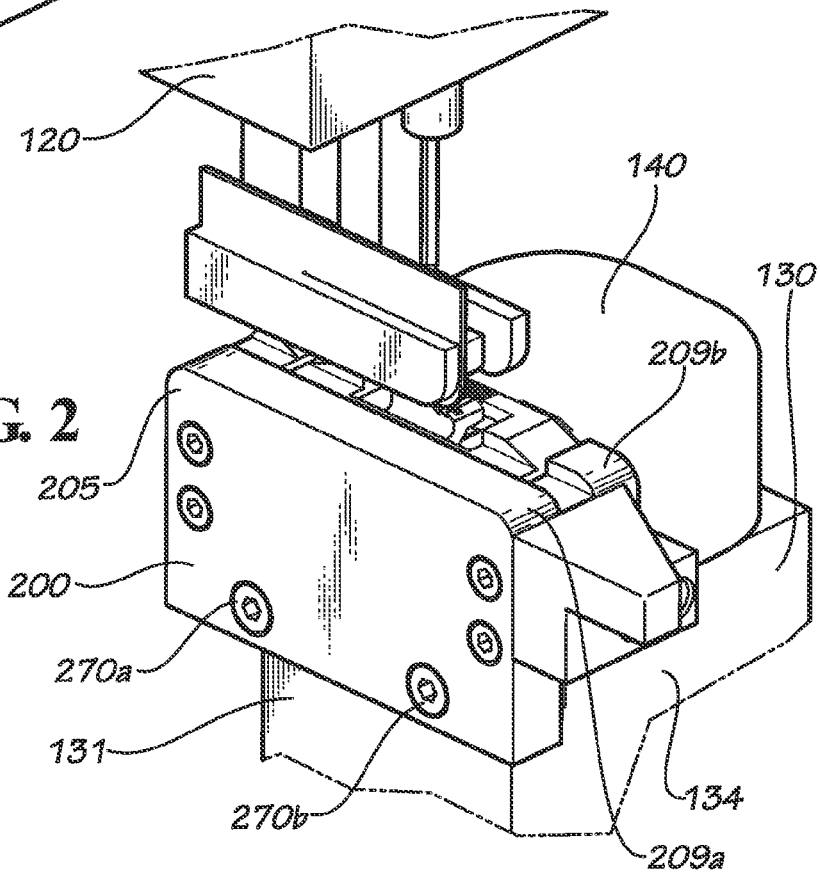
FIG. 2 is a detail perspective view of the support guide assembly and sewing machine of FIG. 1.

Disclosed in FIG. 2 is a detail perspective view of the sewing system 100 of the embodiment of FIG. 1. Shown is support guide assembly 200 attached to post 130, post 130 having left wall 131, rear wall (not shown), right wall 133 (shown in FIG. 3), and front wall 134. At least a portion of the top of post 130 is shown covered with cover 140. Securing a support guide 205 of the support guide assembly 200 to post 130 are fasteners 270*a,b* (shown also in FIG. 11).

Figure 3:
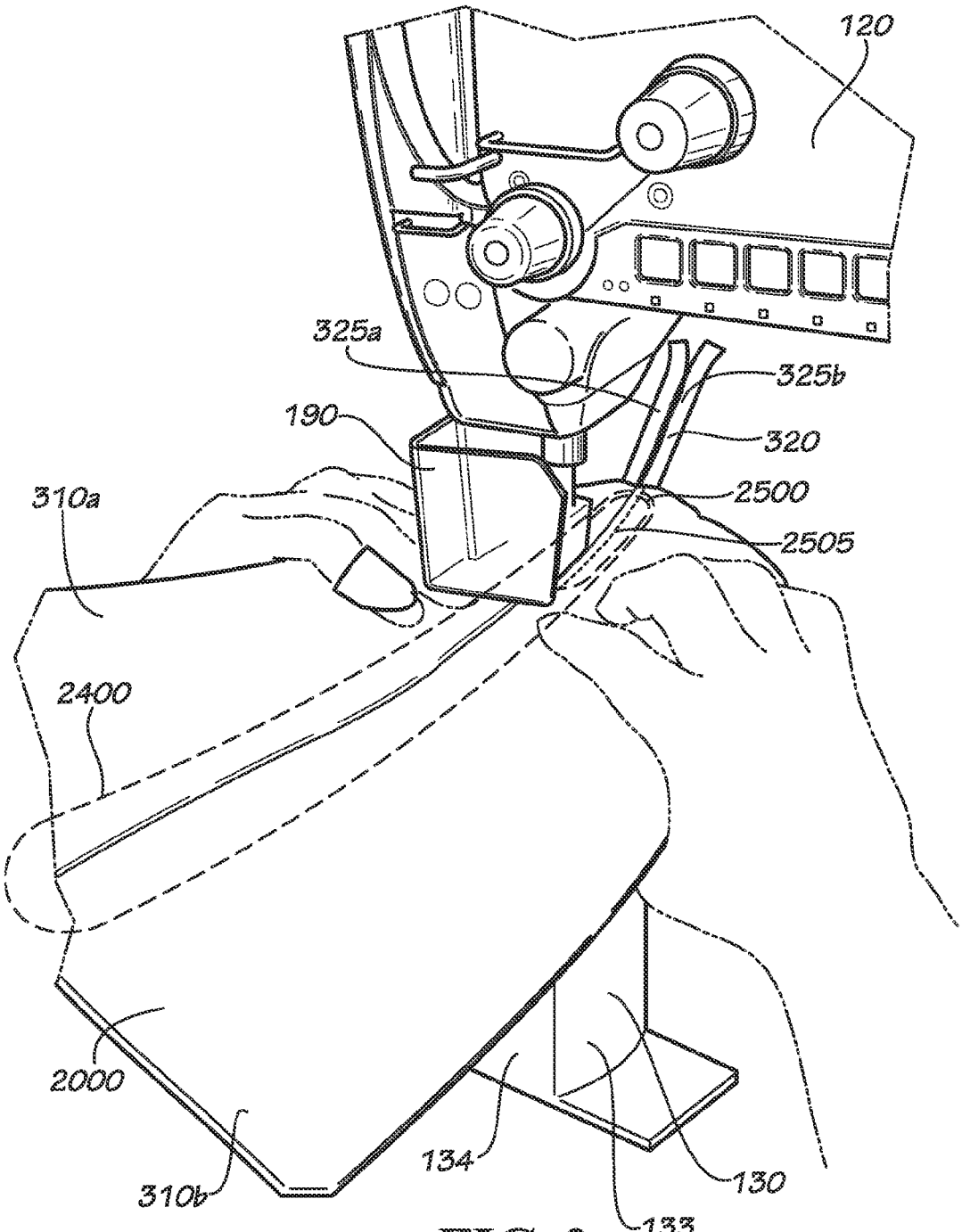
FIG. 3 is a perspective view of an embodiment of the support guide of FIG. 1 mounted on a sewing machine while the machine is in use sewing a decorative topstitch with a concealed slide fastener.

Disclosed in FIG. 3 is a perspective view of a second embodiment of a system—as it is being used—in this particular case for making a deck seam with a slide fastener. See below for a more detailed description of the aforementioned joint seam, deck seam, and French seam. FIG. 3 also shows the incorporation of a safety guard 190.

A first sewing panel 310*a* is shown already joined to a second sewing panel 310*b* by a joint seam 2400 containing a slide fastener 320, which in the current embodiment is concealed. In various embodiments, the slide fastener is not concealed or is only partially concealed. This sewn assembly of the first sewing panel 310*a*, second sewing panel 310*b*, and slide fastener 320 together forms a sewn article 2000. A first joining part 325*a* of slide fastener 320 is joined to a first joining edge 330*a* (shown in FIG. 7) of the first sewing panel 310*a*, and a second joining part 325*b* of slide fastener 320 is joined to a second joining edge 330*b* (also shown in FIG. 7) of the second sewing panel 310*b*. In various embodiments, first joining part 325*a* includes first joining portion 322*a* and second joining part 325*b* includes second joining portion 322*b*. While feeding a sewn article 2000 by hand between post 130 and needle 180 (shown in FIG. 4) of a needle surround structure 150 (shown in FIG. 7) of sewing machine 105, sewing machine 105 modified with support guide assembly 200 (shown in FIG. 1) sews a decorative topstitch 2505 on one side of the joint seam 2400 through the second sewing panel 310*b* and also through slide fastener 320, forming deck seam 2500.

As shown in FIG. 3, the bottom or inside of sewn article 2000 is hidden from the operator, especially at the point where the sewing machine 105 holds down the sewn article 2000 and forms decorative topstitch 2505. As will be explained in further detail below, the inability of the operator of the sewing machine 105 to see the bottom of sewn article 2000—from which side also the slide fastener 320 is visible—is at least one reason why the structure, systems, and methods disclosed herein are useful. In various embodiments, front guide 230 (shown in FIG. 4) is included in support guide 205 (shown in FIG. 2) to help the sewing machine operator line up a bottom 710 of the slide fastener 320 with a bottom 281 (shown in FIG. 4) of a groove 206 (shown in FIG. 6). In various embodiments, a groove is not required but rather there is only a space between a first top surface 822 and a second top surface 824. In the current embodiment, a top surface 231 (shown in FIG. 4) of front guide 230 (shown in FIG. 4) acts as a shelf to "catch" the sewn article 2000 so that the bottom of sewn article 2000 is lined up with a bottom 281 (shown in FIG. 4) of a groove 206 (shown in FIG. 6), the operator need only line up the center of the joint seam 2400 with the center guide 170 (shown in FIG. 4) above the sewn article 2000 and the groove 206 at the bottom below the sewn article 2000, having already positioned the sewn article 2000 vertically so that it can go straight into the sewing machine 105 (shown in FIG. 1) without raising or lowering the sewn article 2000. While top surface 231 of front guide 230 is in a horizontal orientation and also coplanar with bottom 281 of groove 206, in various other embodiments the top surface of the front guide can be angled up towards the entrance and incorporate one or more surfaces, with or without a radii, for example to provide clearance for sewn article 2000 or to improve the ergonomics for the sewing machine operator.

One or more guide lips 209*a,b,c,d,e* (*a,b* shown in FIG. 4, *c,d* shown in FIG. 10, *e* shown in FIG. 20) are defined by the support guide 205 in various embodiments (shown in FIG. 2). The guide lips 209*a,b,c,d,e* of the current embodiment define a radiused surface resembling a fillet. In various other embodiments, one or both of the guide lips 209*a,b,c,d,e* will define a planar surface resembling a chamfer. Other shapes of the guide lips are present in various embodiments, including, but not limited to, curved surfaces with varying radii and planar surfaces with varying angles relative to the first top surface 822 and second top surface 824. These guide lips 209*a,b,c,d,e*, which will be adjacent to a groove entrance 207 (shown in FIG. 4) in various embodiments, help guide the sewn article 2000, especially first sewing panel 310*a* and second sewing panel 310*b*, through the sewing machine 105 and across the support guide 205. In various embodiments, the guide lips 209*a,b,c,d,e*, especially guide lips 209*a* and 209*b*, prevent the sewing panels 310*a,b* from catching or hanging up on the sewing machine 105. The guide lips 209*a,b* provide a smooth transition from the top surface 231 of the front guide 230 to the top 223 (shown in FIG. 15) of left guide 220 (shown in FIG. 15) defining a first top surface 822 (shown in FIG. 8) of the left guide 220 (shown in FIG. 15) and also to top front portion 214*a*, top rear portion 214*b*, and top 213 (all shown in FIG. 12) of the grooved throat plate 210 (shown in FIG. 7), together defining a second top surface 824 (shown in FIG. 8). In various embodiments, top surface 2200 (shown in FIG. 22) is coplanar with second top surface 824. Guide lips 209*c,d,e* are also present in various embodiments to provide a smooth transition as the sewn article 2000 moves through and exits the sewing machine 105. Also shown in FIG. 3 is right wall 133 of post 130 with post 130 (shown attached to base 110 in FIG. 1).

Figure 4:
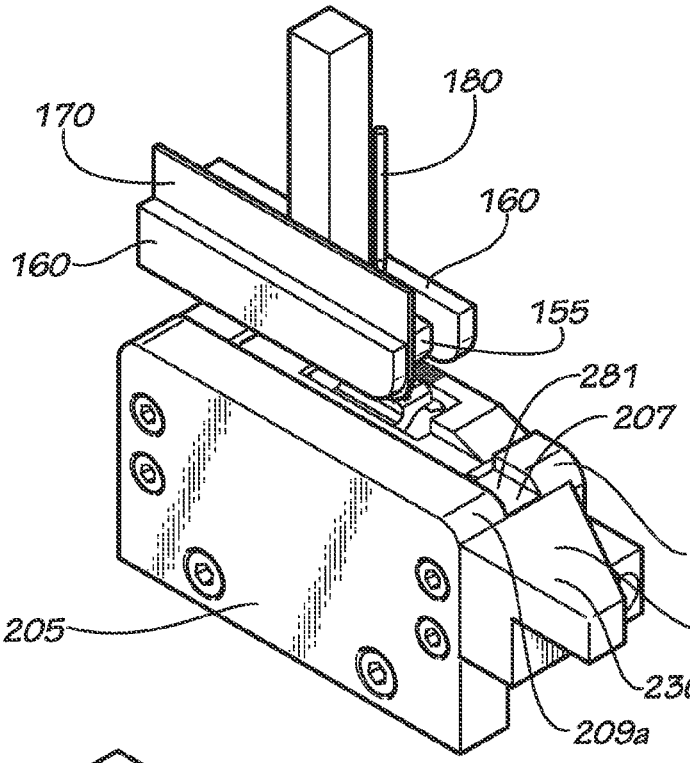
FIG. 4 is a detail perspective view of the support guide assembly and a needle surround structure of the sewing machine of FIG. 1.

Disclosed in FIG. 4 is a detail perspective view of the support guide 205 of the support guide assembly of FIG. 2 together with the needle surround structure 150 but without the other structure of sewing machine 105. Support guide 205 includes front guide 230, which helps support and guide sewn article 2000 with slide fastener 320 into and through sewing machine 105. Needle surround structure 150 includes an upper inner foot 155, an upper outer foot 160, a needle 180, and a center guide 170. In various embodiments, upper inner foot 155 and upper outer foot 160 can be described as a presser foot or presser foot assembly because it is the foot (or feet) that "presses" down on the material being fed through the sewing machine 105.

A simplified representation of needle surround structure 150 is shown in these and other figures of the present disclosure. One of ordinary skill in the art would recognize that the shape of certain existing components of sewing machine 105 would be either more complex or less complex in shape or otherwise vary in exact shape, size, or orientation due to differences in the sewing machines and specific sewing applications that can be adapted for the disclosed systems and methods—for example, the specific configuration most suitable for sewing a seat cover (as shown in FIG. 3, for example) versus that for sewing a headrest cover may vary as would the configuration for using a single needle machine for a deck seam (or a French seam sewn in two "passes") versus using a twin needle machine for a French seam sewn in one "pass." One "pass" represents one pass of sewn article 2000 through sewing machine 105.

Sewing thread is not shown in any of the figures showing sewing system 100 or portions thereof, but it would be recognized that the sewing thread that makes up decorative topstitch 2505 of deck seam 2500 or a decorative topstitch 2605*a,b* of a French seam 2600 (shown in FIG. 26) would be part of both the first embodiment (shown in FIG. 1) and the second embodiment and other embodiments of sewing system 100. There would typically be at least two pieces of sewing thread, one fed from the top around or through arm 120 of sewing machine 105, and at least one fed from the bottom around or through post 130, forming a "lockstitch" that cannot be easily undone, though different thread arrangements may be present in various embodiments.

Figure 5:
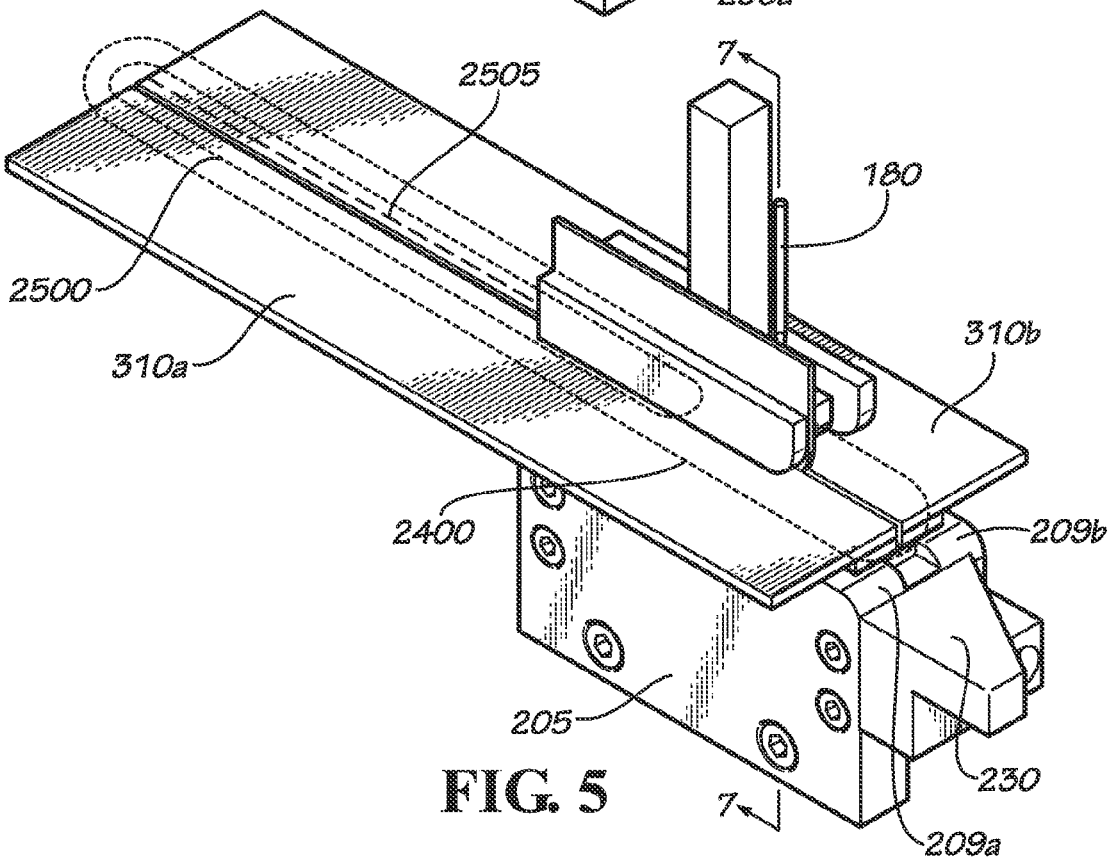
FIG. 5 is a detail perspective view of the support guide assembly and needle surround structure of FIG. 4 with sewn article shown partially processed.

Disclosed in FIG. 5 is a detail perspective view showing sewn article 2000 partially passed between the support guide 205 and needle surround assembly of FIG. 2. That portion of sewn article 2000 which has passed through the machine can be seen with decorative topstitch 2505 forming deck seam 2500. As shown in FIG. 3, the sewn article 2000 includes joint seam 2400 before the creation of deck seam 2500. Sewn article 2000 is shown rigid enough to remain perfectly flat in the simplified representation of FIG. 5. In many applications, sewn article 2000 would be more flexible as shown in FIG. 3 and/or radiused and therefore wrap around the post. This disclosure includes sewing machines without a post (for example, a flat bed sewing machine or a cylinder arm or cylinder bed sewing machine) with adjustments made to the detailed shape and orientation of individual parts of the support guide assembly and surrounding structure as needed. While a commercial machine as shown will often be the most suitable for the disclosed applications, this disclosure also includes embodiments of the disclosed systems and methods making use of residential or light-duty sewing machines in various configurations, typically for home use or light commercial use.

Figure 6:
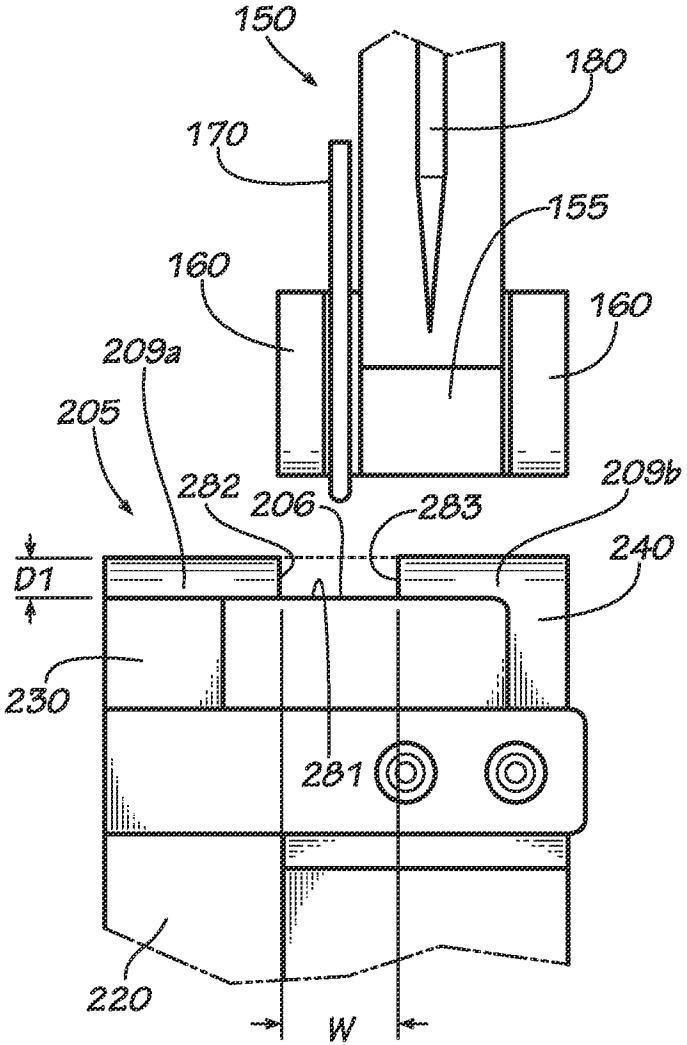
FIG. 6 is a front view of the support guide assembly and needle surround structure of FIG. 4.

Disclosed in FIG. 6 is a front view of the support guide 205 and needle surround structure 150 shown already in perspective view in FIG. 4. The top surface 231 of front guide 230 of support guide 205 is shown to be flush (i.e. coplanar) with the groove 206 of support guide 205, groove 206 sized to accept the height and width of the connecting elements 321*a,b* (shown in FIG. 7) of slide fastener 320 (shown next in FIG. 7). Groove 206 includes the bottom 281, a left wall 282, and a right wall 283. Groove 206 is shown with depth D1 and width W. This disclosure includes various embodiments in which depth D1 and width W and the shape of the groove 206 itself (for one example among others, having curved or radiused walls inside one or more areas of the groove 206) vary based on the various dimensions and shapes of the various slide fasteners that are available. The groove 206 will be sized to accept only the connecting elements of slide fastener 320 in various embodiments, but in other embodiments it can be sized to accept other portions of slide fastener 320. The size and shape of groove 206 of the current embodiment is based on use of a slide fastener 320 that is commonly used in other seat cover applications using a slide fastener but which make use of seam configurations other than those presently disclosed. In various embodiments, the slide fastener 320 is a concealed type slide fastener (e.g. YKK® CONCEAL® fastener, 5CH), though other slide fasteners 320 and other models of concealed type slide fasteners may be present in various embodiments.

Figure 7:
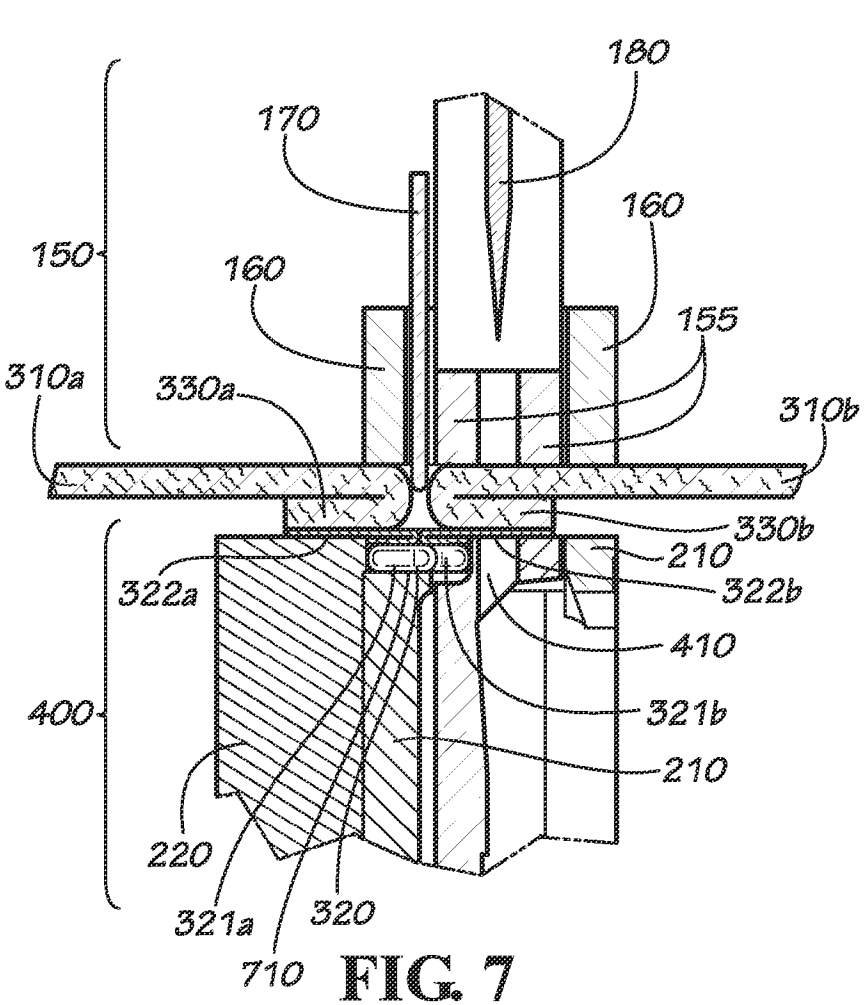
FIG. 7 is a sectional view of the support guide assembly and needle surround structure of FIG. 5 taken along line 7-7 of FIG. 5.

Disclosed in FIG. 7 is a sectional view of a support guide surround structure 400 and the needle surround assembly of FIG. 5 taken in a vertical plane at line 7-7 in FIG. 5. FIG. 7 shows the cross-section of the elements in FIG. 5 at the needle and from the same perspective as FIG. 6. Included is a sectional view of a lower foot 410, also sometimes referred to as a feed dog. In the current embodiment of sewing system 100, support guide 205 and lower foot 410 together make up support guide surround structure 400. While upper inner foot 155 and upper outer foot 160 "walk" the sewn article 2000 through the sewing machine 105 from the top by putting continuous pressure on outside surfaces 2511*a,b* of the first sewing panel 2510*a* (shown in FIG. 25) and second sewing panel 2510*b* (shown in FIG. 25), respectively, lower foot 410 helps advance the sewn article 2000 through the sewing machine 105 from the bottom by putting pressure on inside surface 2512*b* (in a deck seam application on a single needle sewing machine) of the second sewing panel 2510*b*. Center guide 170 can help to center the sewn article 2000 about the seam 2500 on which the decorative topstitch 2505 is being added. In various embodiments of a twin needle application of decorative topstitching on a seam containing a slide fastener (not shown), there are more than one lower foot and more than one throat plate. The slide fastener is concealed in various embodiments, and the slide fastener is not concealed in various other embodiments. In various embodiments, the lower foot, the upper inner foot, and upper outer foot will be adjusted in size, shape, and position out of necessity by the manufacturer of the sewing machine to adjust the particular design of that sewing machine and the specific sewn article being processed.

FIG. 7 also shows a simplified representation showing the various parts of the seam itself—in this case a deck seam 2500 being created by the addition of decorative topstitch 2505 (shown in FIG. 5). First joining portion 322*a* of slide fastener 320 is shown already sewn or otherwise affixed to first joining edge 330*a* of first sewing panel 310*a*. Second joining portion 322*b* of slide fastener 320 is shown already sewn or otherwise affixed to second joining edge 330*b* of second sewing panel 310*b*. In various embodiments, the first joining portion 322*a* and second joining portion 322*b* of slide fastener 320 can together be described the "tape" or tape portion of the slide fastener. The tape or joining portions 322*a,b* can be made out of one or more of a variety of typically flexible materials including but not limited to fabric and polymeric materials and can be woven or extruded or manufactured in other ways. Shown here also are a first and second set of connecting elements 321*a,b*. A first set of connecting elements 321*a* is connected to first joining portion 322*a* of slide fastener 320, and a second set of connecting elements 321*b* is connected to second joining portion 322*b* of slide fastener 320. In various embodiments, the connecting elements 321*a,b*, sometimes referred to as the "chain" or "coil" of the slide fastener, will include a plurality of teeth, one set of teeth along the edge of each connecting element, that are designed to be brought together into interlocking engagement by the use of a slider 340 of slide fastener 320. The slider 340 accepts both sets of teeth of connecting elements 321*a,b*, one in each side of the slider 340. When the slider 340 slides up and down the two sets of teeth, it causes the connection between the connecting elements 321*a,b* to either open or close.

Figure 8:
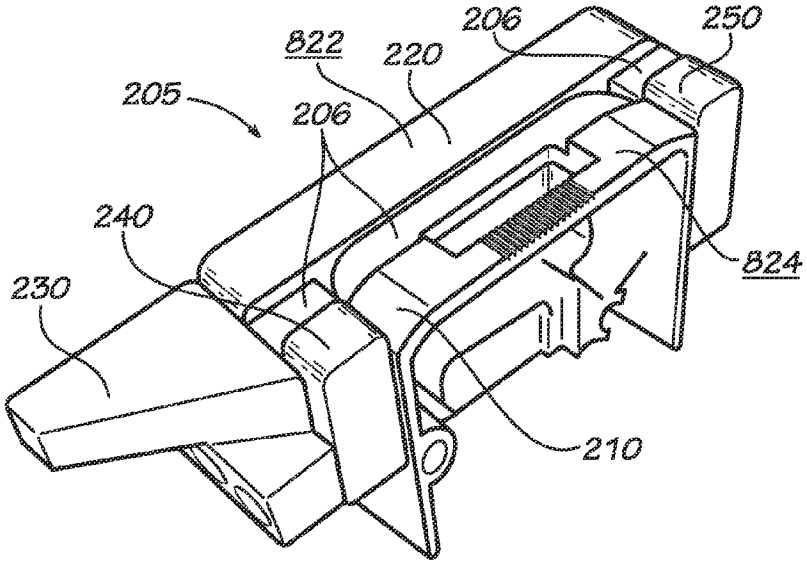
FIG. 8 is a first perspective view of a support guide of the support guide assembly of FIG. 4.

Disclosed in FIG. 8 is a first perspective view of the support guide 205 of FIG. 4. This view is taken facing the surfaces that mate with post 130 of sewing machine 105 during installation of support guide 205 of support guide assembly 200. Included in support guide 205 is a grooved throat plate 210, a left guide 220, the aforementioned front guide 230, a front guide spacer 240, and a rear guide spacer 250. The support guide 205 includes the first top surface 822 defined on the left guide 220 and the second top surface 824 defined on the throat plate 210, though the first top surface 822 and the second top surface 824 are defined on other elements of the support guide 205, including both the first top surface 822 and the second top surface 824 being defined on the same element such as the throat plate 210, in various embodiments. The first top surface 822 and the second top surface 824 are substantially coplanar in the current embodiment and are spaced apart from each other, defining groove 206 therebetween. In the current embodiment, groove 206 is defined by various surfaces of the grooved throat plate 210, the left guide 220, the front guide 230, the front guide spacer 240, and the rear guide spacer 250. In various embodiments, the groove 206 need not be defined by anything other than the two surfaces spaced apart from each other.

Figure 9:
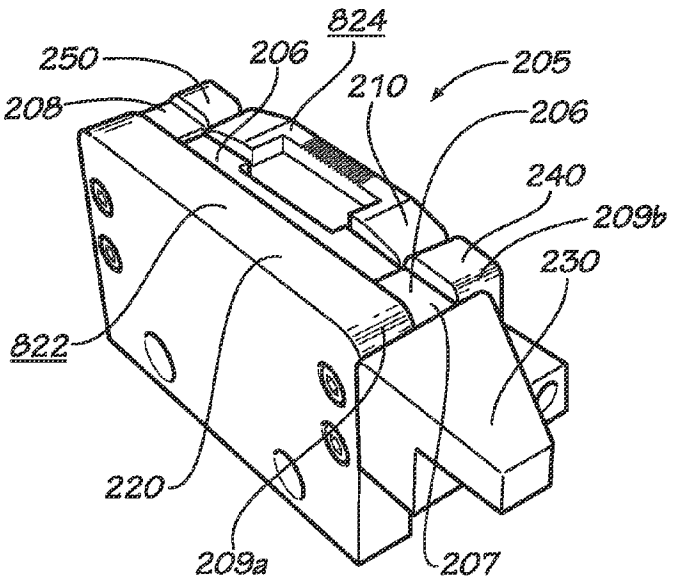
FIG. 9 is a second perspective view of the support guide of FIG. 8.

FIG. 9 discloses the same elements shown in FIG. 8 in a second perspective view of support guide 205 but is taken facing the surfaces opposite of those surfaces that mate with post 130 of sewing machine 105 during installation of support guide 205 of support guide assembly 200. Also shown are groove entrance 207 and groove exit 208.

Figure 10:
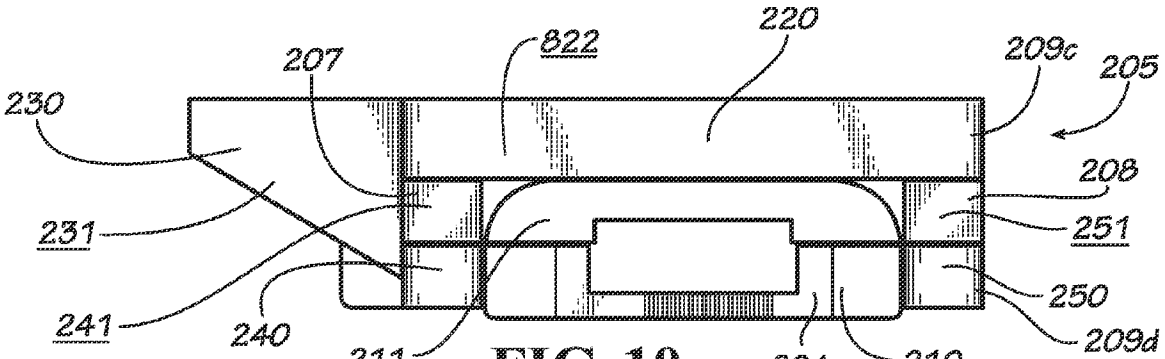
FIG. 10 is a top view of the support guide of FIG. 8.

Disclosed in FIG. 10 is a top view of the support guide 205 of FIG. 4. Front guide 230 is shown with top surface 231, front guide spacer 240 is shown with groove bottom surface 241, rear guide spacer 250 is shown with groove bottom surface 251, and grooved throat plate 210 is shown with groove bottom surface 211, also defined by bottom 281 (shown in FIG. 6) of groove 206. In the current embodiment, the groove 206 has constant width W from groove entrance 207 to groove exit 208. In various embodiments, the groove has a width at groove entrance 207 that is wider than width W as shown in FIG. 6. This greater width at groove entrance 207 can be accomplished by adding chamfers, fillets, or radii to left guide 220 and front guide spacer 240. In various embodiments, such geometry is desired in order to direct the sewn article 2000 into groove entrance 207 more easily. If it is easier to direct sewn article 2000 into groove entrance 207, the delay between sewing of each instance of sewn article 2000 can be reduced and therefore the overall productivity of the manufacturing process can be improved. In a similar way in other embodiments, various other edges of support guide 205 and the edges of individual parts of the support guide 205 like front guide 230 can be chamfered or radiused in order to direct the sewn article more easily onto the front guide, for example.

Figure 11:
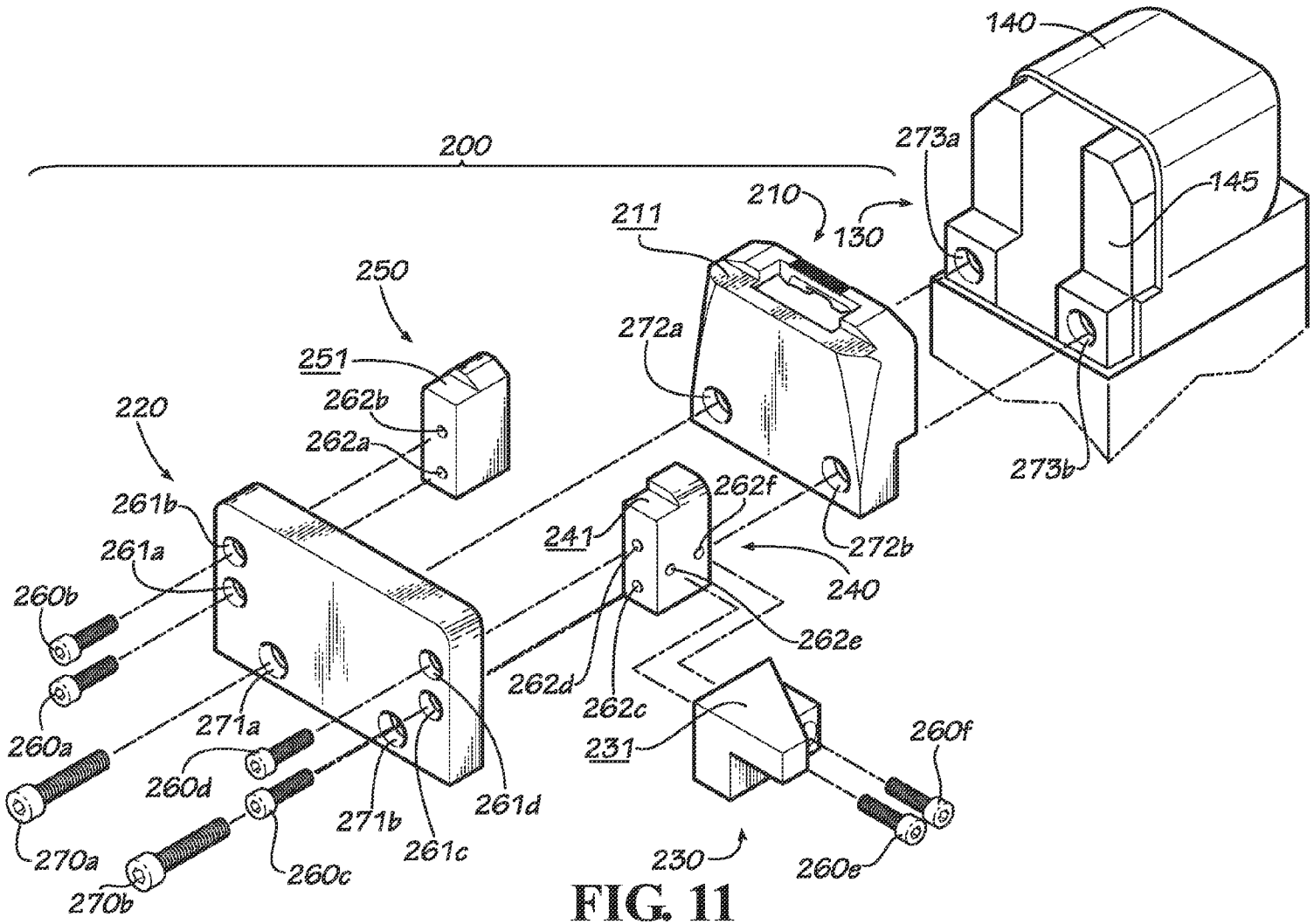
FIG. 11 is an exploded view of the support guide assembly of FIG. 4 together with a mating part of the sewing machine of FIG. 1.

Disclosed in FIG. 11 is an exploded view of the support guide assembly 200 shown in FIG. 1 together with the mating part of sewing machine 105 in FIG. 1. In the current embodiment, left guide 220, front guide 230, front guide spacer 240, and rear guide spacer 250 are assembled to each other using fasteners 260*a-f*. Fasteners 260*a,b* connect left guide 220 with rear guide spacer 250. Fasteners 260*c,d* connect left guide 220 with front guide spacer 240. Fasteners 260*e,f* connect front guide 230 with front guide spacer 240. Once assembled, these elements together are assembled to grooved throat plate 210 when installing support guide 205 on sewing machine 105 with fasteners 270*a,b*. In the current embodiment, fasteners 260*a-f* and 270*a,b* are M5 threaded fasteners with a hex key recess in the head. Fasteners 270*a,b* are sized to match matching holes 273*a,b* in frame 145 of post 130 of sewing machine 105.

In various other embodiments, fasteners 270*a,b* have a different thread length, diameter, and/or pitch to accommodate different sewing machines and/or sewing applications. In various embodiments, there is only one fastener required to attach the support guide to the machine, or the support guide will be attached in such a way that no fasteners are required. In various embodiments, the one fastener is a quick release fastener (not shown) and is incorporated to allow a sewing machine operator to quickly—without tools—remove one version of a support guide and replace with another version of a support guide to accommodate a different type of topstitching and/or a different size or shape of slide fastener. The quick release fastener could be in the form of one or more large knurled knobs that can be removed quickly but not interfere with the operator or with sewn article 2000, or it could be in the form of one or more locking pins that positively secure the support guide 205 to the post 130 but can be removed quickly as needed. This disclosure includes other structures and methods for such a quick-release fastener that would have the same function as that disclosed herein.

Shown in FIGS. 12, 13, and 14 are a top view, a side view, and a front view, respectively, of the grooved throat plate 210 of the support guide 205 of FIG. 4. Surface 211 defines a portion of the bottom 281 of groove 206, and surfaces 212*a,b* define the right wall 283 of groove 206. The highest point on top 213 is flush with a top 223 of left guide 220 and the top-most portion of cover 140. Top 213 includes top front portion 213*a*, top middle portion 213*b*, and top rear portion 213*c*. In the current embodiment, top front portion 214*a* slopes down and away from top front portion 213*a* and top rear portion 214*b* slopes down and away from top rear portion 213*c*. In various other embodiments, 213*a-c* and 214*a,b* are coplanar in order to eliminate the recess that would otherwise exist between grooved throat plate 210 and front guide spacer 240 and rear guide spacer 250. Top middle portion 213*b* has a rough surface in various embodiments that roughly matches the surface at the top end of the lower foot 410 (also known as a feed dog). Cutout 215 is included in grooved throat plate 210 to provide clearance at least for the lower foot 410 and the needle 180. Also shown is outside 216, inside 217, front 218, and rear 219. Included also are holes 272*a,b* to provide clearance for fasteners 270*a,b*. In various embodiments, the grooved throat plate 210 is prepared by modifying a standard throat plate by simply removing material to create the groove. In various embodiments, the grooved throat plate 210 can also be fabricated from scratch by manufacturing processes including but not limited to molding and machining and, in various embodiments, will have material removed from inside 217 or from other areas of throat plate 210 so that it clears the frame 145 of post 130.

Figure 15:
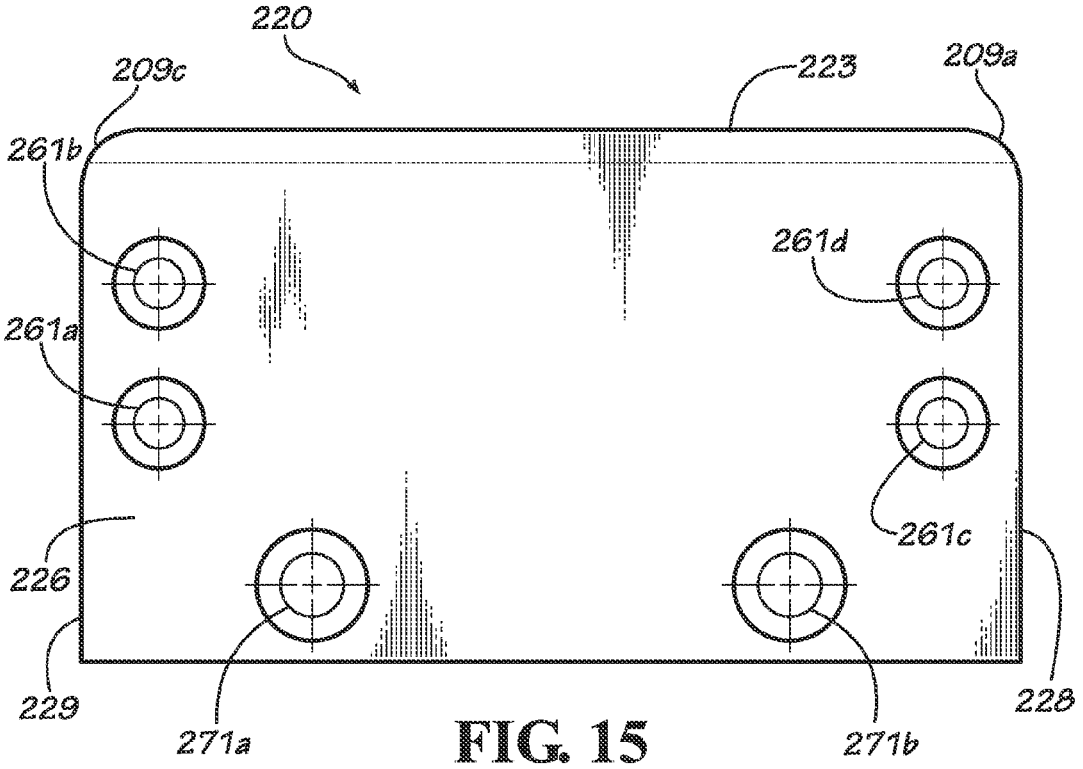
FIG. 15 is a side view of a left guide of the support guide of FIG. 8.
Figure 16:
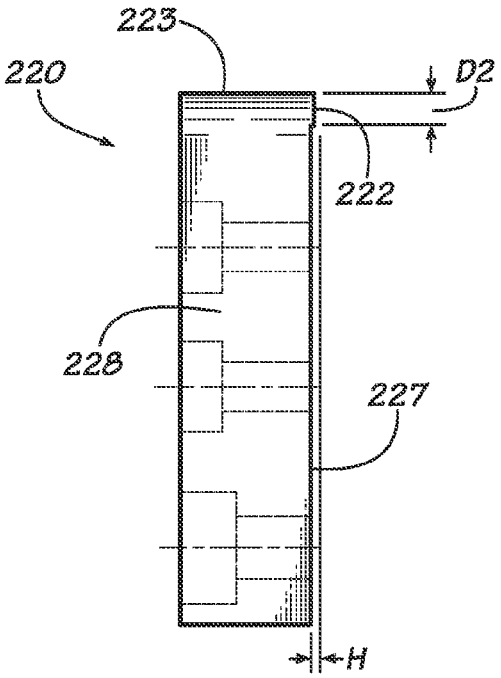
FIG. 16 is a front view of the left guide of FIG. 15.

Disclosed in FIGS. 15-16 is a side view and front view, respectively of the left guide 220 of the support guide 205 of FIG. 4. Left guide 220 includes top 223, left side 226, right side 227, front 228, and rear 229. Clearance holes 261*a-d* provide clearance for fasteners 260*a-d*, while clearance holes 271*a,b* provide clearance for fasteners 270*a,b*. Right side 227 of left guide 220 has a step 222 having height H and depth D2. Step 222, also defining left wall 282 of groove 206, allows for width W and position of groove 206 to be controlled.

Figure 19:
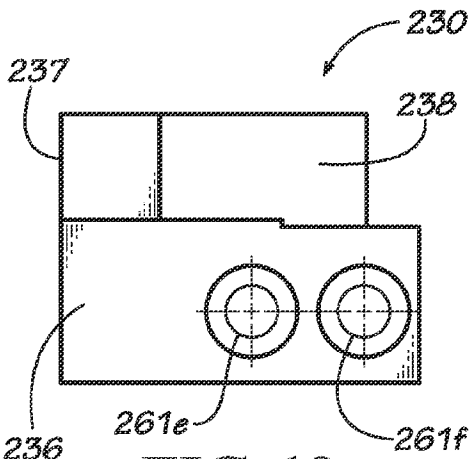
FIG. 19 is a front view of the front guide of FIG. 17.
Figure 18:
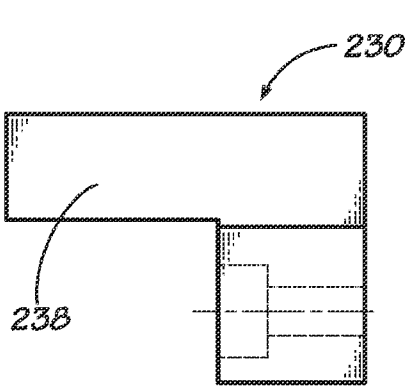
FIG. 18 is a side view of the front guide of FIG. 17.
Figure 17:
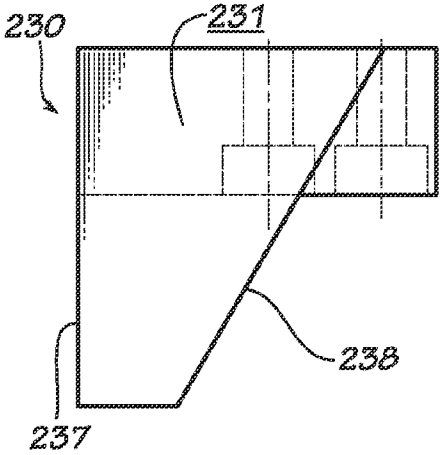
FIG. 17 is a top view of a front guide of the support guide of FIG. 8.

Disclosed in FIGS. 17-19 is a top view, a side view, and a front view, respectively, of the front guide 230 of support guide 205 of FIG. 4. As shown in FIG. 17 and in several other figures disclosed herein, the right or inboard side of front guide 230 is tapered towards the front so that the width of front guide 230 narrows away from where it is connected to the rest of support guide 205. In other words, the front guide is tapered such that a narrow end of the front guide is distal from the groove and a wider end of the front guide is proximate to the groove.

In the current embodiment, the front guide 230 has a left side 237 which is parallel to a centerline of groove 206. Front guide 230 has a right side 238, the right side angled between about 30 degrees and 60 degrees with respect to the centerline of the groove 206. The angle can be outside of this range in various embodiments. The tapered shape of front guide 230 helps direct up and towards the right and over the support guide 205 the bulk of material making up the bottom of joint seam 2400 (for example, first joining edge 330*a* of the first sewing panel 310*a* and a second joining edge 330*b* of the second sewing panel 310*b*). This can be especially useful in embodiments where the slide fastener or zipper does not run the full length of the seam. In these and other embodiments with a joint seam, there can sometimes be additional material that is not present in a joint seam incorporating a slide fastener and that additional material can be directed to lay flat in a certain orientation because of the tapered shape of the front guide. It is also desirable in various embodiments to use the same sewing system or setup disclosed herein for sewing seams, a deck seam as one example among others, that include no slide fastener 320 because this can provide convenience to an operator who would otherwise need to switch between different sewing machine setups of systems to produce different seams. Because this bulk of material is hidden from direct view of the operator, the material being on the bottom, the tapered shape of the front guide 230 and the presence of groove 206 help guide the various parts of the sewn article 2000 into and through the sewing machine 105 for a consistent seam by not allowing the material to hang up or catch on any portion of the support guide 205 or sewing machine 105. In various other embodiments, the right side of the front guide 230 is be parallel with the centerline of the groove 206 and the left side is be angled or both are angled with respect to the centerline of the groove 206, creating a taper of a different orientation in order to guide material in a different direction on one or both sides.

Figure 21:
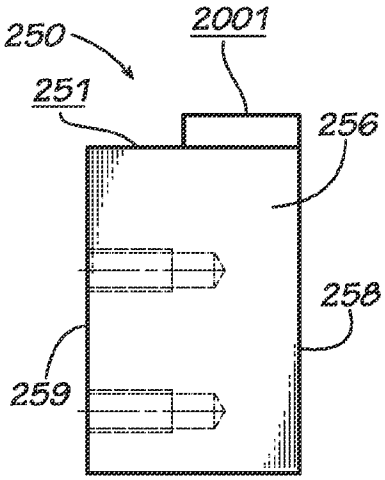
FIG. 21 is a front view of the rear guide spacer of FIG. 20.
Figure 20:
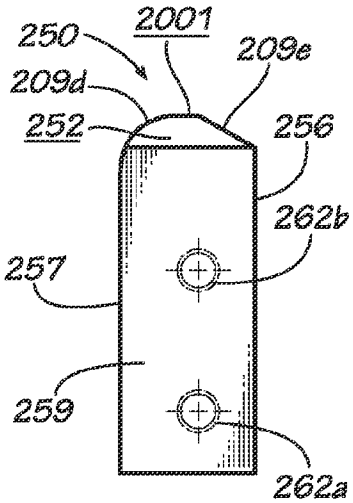
FIG. 20 is a side view of a rear guide spacer of the support guide of FIG. 8.

Disclosed in FIGS. 20-21 is a side view and a front view, respectively, of the rear guide spacer 250 of the support guide 205 of FIG. 4. Shown are groove bottom surface 251, vertical surface 252, front 256, rear 257, right 258, and left 259. Groove bottom surface 251 defines a portion of the bottom 281 of groove 206.

Figure 23:
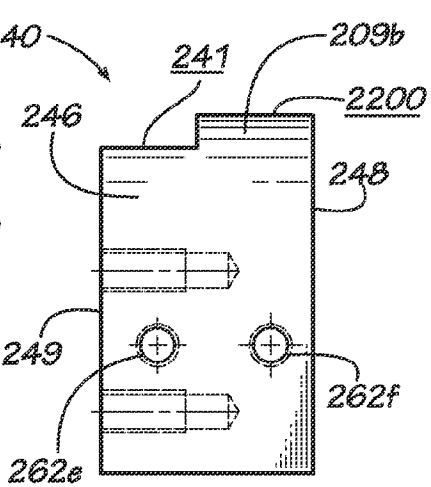
FIG. 23 is a front view of the front guide spacer of FIG. 22.
Figure 22:
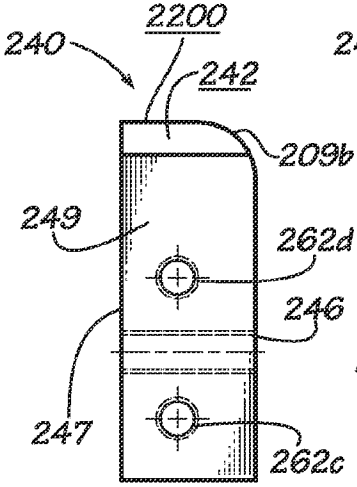
FIG. 22 is a side view of a front guide spacer of the support guide of FIG. 8.

Disclosed in FIGS. 22-23 is a side view and a front view, respectively, of the front guide spacer 240 of the support guide 205 of FIG. 4. Shown are groove bottom surface 241, vertical surface 242, front 246, rear 247, right 248, and left 249. Groove bottom surface 241 defines a portion of the bottom 281 of groove 206.

While support guide 205 is shown as an assembly of multiple parts connected to each other with multiple fasteners, this disclosure includes various embodiments in which the support guide would be cut or formed from fewer elements or even a single piece of material. Whether made from multiple pieces as shown in the current embodiment or combined into one piece, the individual pieces of support guide 205 could be fabricated using a variety of fabrication methods including but not limited to machining and molding. The material making up the support guide 205 can be aluminum, steel including stainless steel, plastic or another polymeric or composite material, or any other material, including material having good machinability or molding properties as appropriate for the fabrication process used.

Figure 26:
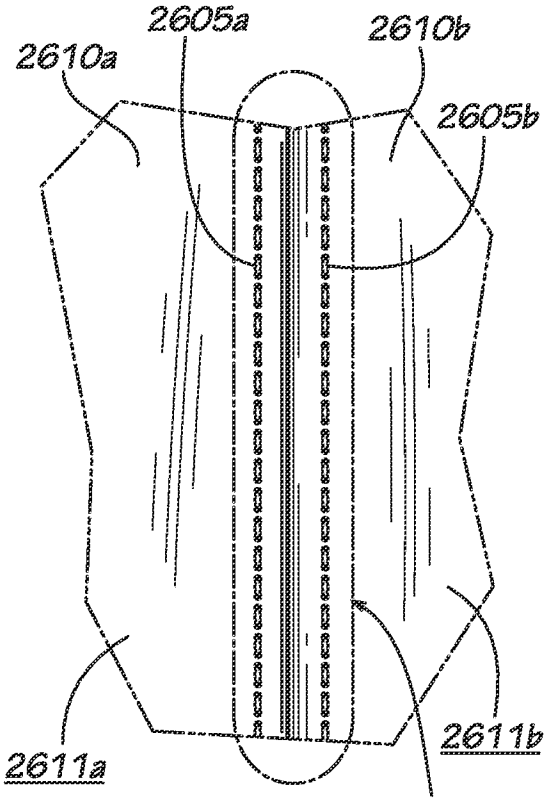
FIG. 26 is an exterior side view of a French seam with a concealed slide fastener.
Figure 25:
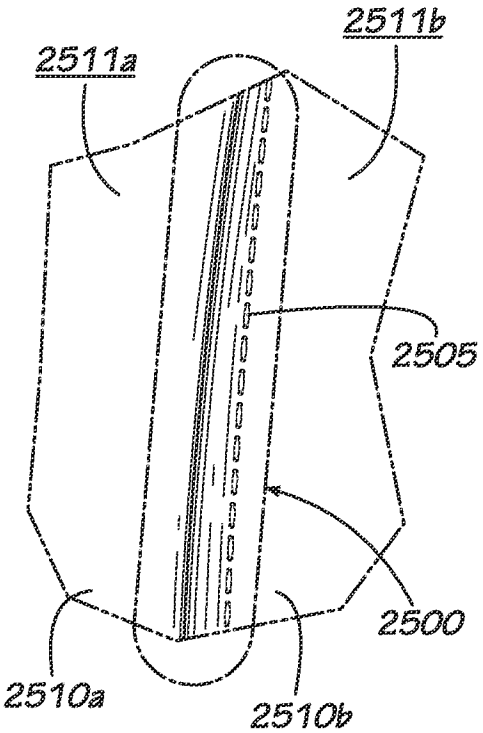
FIG. 25 is an exterior side view of a deck seam with a concealed slide fastener.
Figure 24:
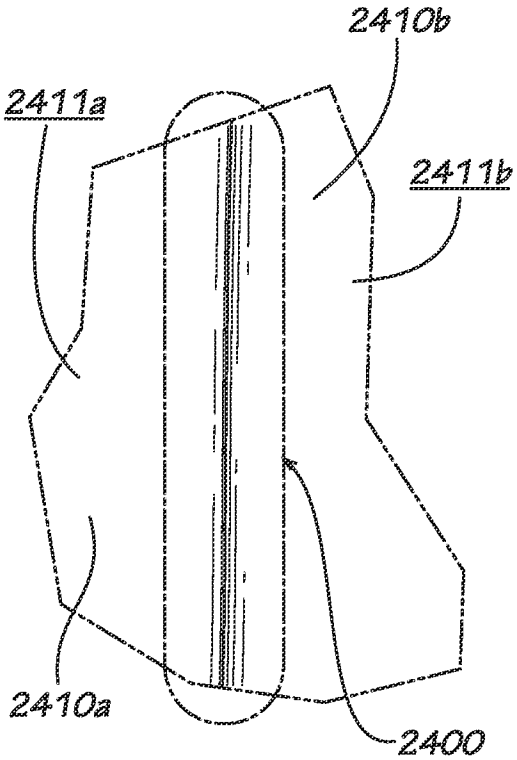
FIG. 24 is an exterior side view of a joint seam with a concealed slide fastener.

Disclosed in FIG. 24 is a perspective view of a joint seam 2400 with or without a slide fastener (not shown) from a position facing outside surfaces 2411*a,b* of first sewing panel 2410*a* and second sewing panel 2410*b*, respectively. Disclosed in FIG. 25 is a perspective view of a deck seam 2500 with a slide fastener 2520 from a position facing outside surfaces 2511*a,b* of first sewing panel 2510*a* and second sewing panel 2510*b*, respectively. Disclosed in FIG. 26 is a perspective view of a French seam 2600 with a slide fastener 2620 from a position facing outside surfaces 2611*a,b* of first sewing panel 2610*a* and second sewing panel 2610*b*, respectively.

Figure 28:
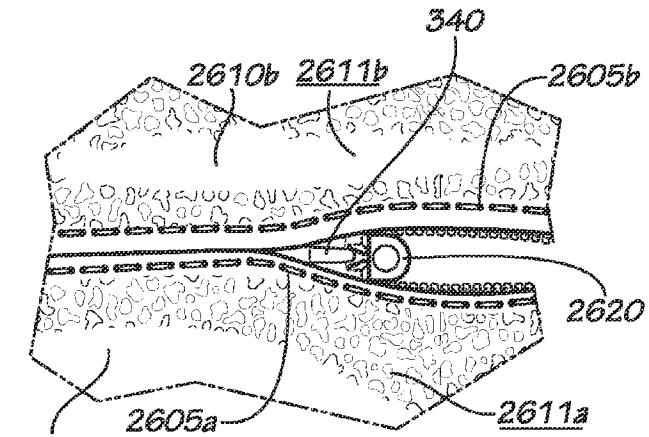
FIG. 28 is an exterior side view of a French seam including a concealed slide fastener with the seam partially open.
Figure 27:
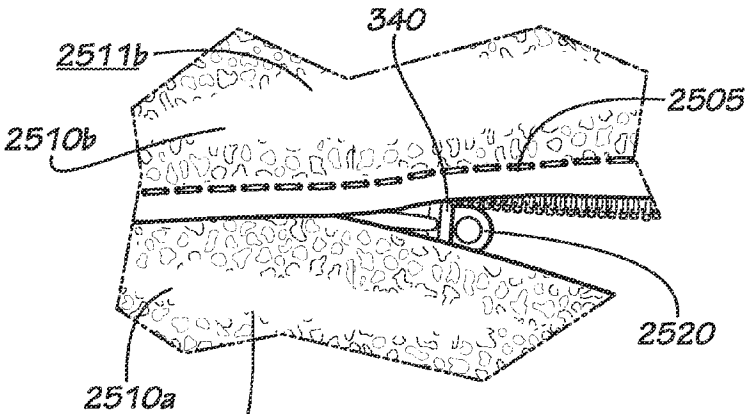
FIG. 27 is an exterior side view of a deck seam including a concealed slide fastener with the seam partially open.

Disclosed in FIG. 27 is a top view of a deck seam 2500 with a slide fastener 2520 from a position facing outside surfaces 2511*a,b* of first sewing panel 2510*a* and second sewing panel 2510*b*, respectively, the deck seam 2500 partially opened or unzipped. In a typical deck seam, decorative topstitching is visible on only one side of the seam. Disclosed in FIG. 28 is a top view of a French seam 2600 with a slide fastener 2620 from a position facing outside surfaces 2611*a,b* of first sewing panel 2610*a* and second sewing panel 2610*b*, respectively, the seam partially opened or unzipped. In a typical French seam, decorative topstitching is visible on each side of the seam. In the embodiments shown of both deck seam 2500 and French seam 2600, however, no part of the slide fastener 2520,2620 is visible when facing the outside surfaces of the respective sewing panels.

Figure 30:
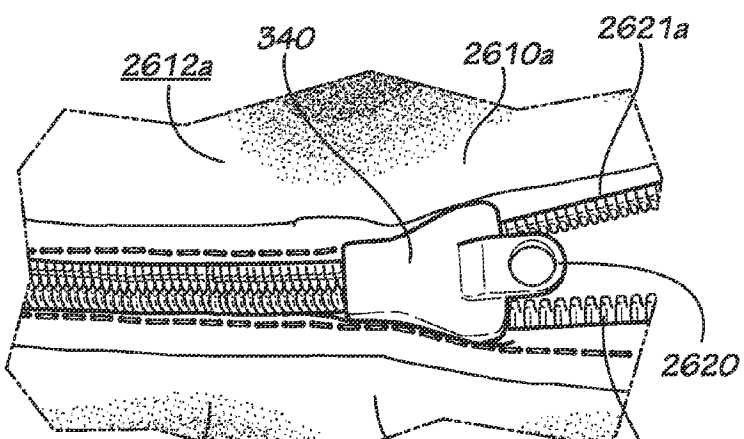
FIG. 30 is an interior perspective view of a French seam including a concealed slide fastener with the seam partially open.
Figure 29:
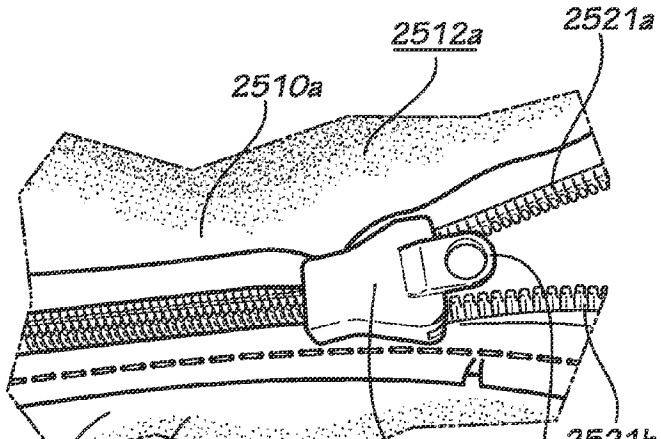
FIG. 29 is an interior perspective view of a deck seam including a concealed slide fastener with the seam partially open.

Disclosed in FIG. 29 is a bottom or inside view of the deck seam 2500 of FIG. 27, from a position facing inside surfaces 2512*a,b* of first sewing panel 2510*a* and second sewing panel 2510*b*, the seam partially open. Disclosed in FIG. 30 is a bottom or inside view of a French seam 2600 with a slide fastener 2620, from a position facing inside surfaces 2612*a,b* of first sewing panel 2610*a* and second sewing panel 2610*b*, the seam partially open. In FIGS. 29-30, connecting elements 2521*a,b* and 2621*a,b*, respectively, are visible.

Figures 31, 32, 33:
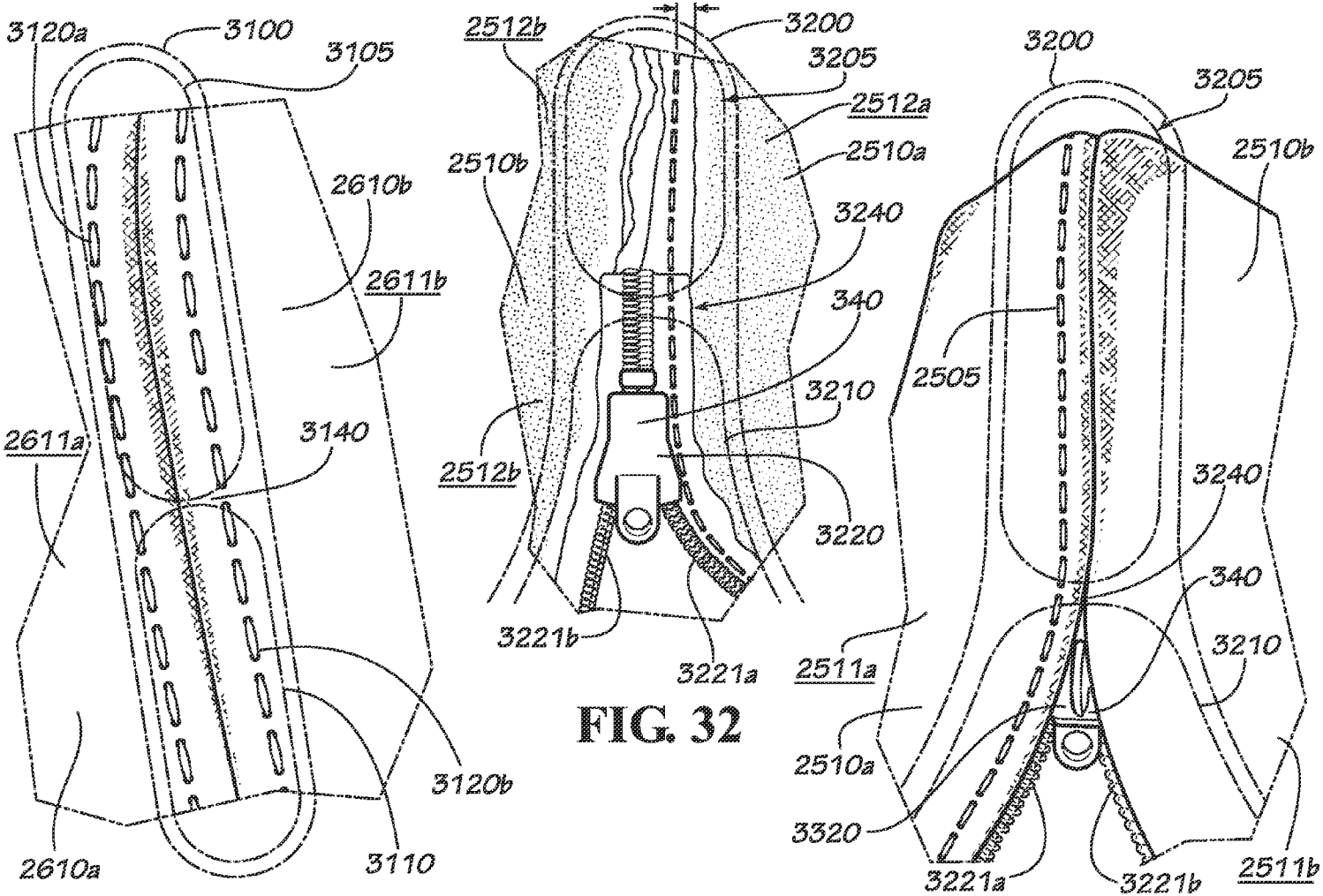
FIG. 31 is an exterior perspective view of a French seam with a concealed slide fastener behind a lower portion of the seam and no slide fastener behind an upper portion of the seam and a transition point in between the upper portion and lower portion.
FIG. 32 is an interior perspective view of a deck seam showing no slide fastener behind an upper portion of the seam and the lower portion including the concealed slide fastener at least partially open.
FIG. 33 is an exterior perspective view of the deck seam of FIG. 32, again with the concealed slide fastener at least partially open.

Disclosed in FIG. 31 is an outside perspective view of a French seam 3100 with a slide fastener (not shown) behind a lower portion 3110 and no slide fastener behind an upper portion 3105 and a transition point 3140 in-between the upper portion and lower portion. This view is taken from a position facing outside surfaces 2612*a,b* of first sewing panel 2610*a* and second sewing panel 2610*b*, respectively. It can be difficult to produce a deck seam or a French seam including a slide fastener in one portion of the seam and not including a slide fastener in another portion of the seam because there will be some evidence on the outside or visible or top surface that the structure of the seam underneath varies from one portion to the next. The support guide 205 disclosed herein overcomes this issue by at least supporting the sewn article 2000 in such a way that the sewing machine 105 is to produce a consistent seam, the appearance of which from the exterior of the sewn article 2000 is unaffected by whether there is a slide fastener or not.

Disclosed in FIG. 32 is an inside perspective view of a deck seam 3200 with a slide fastener behind a lower portion 3210 and no slide fastener behind an upper portion 3205 and a transition point 3240 in-between the lower portion 3210 and upper portion 3205. Also visible in FIG. 33 are connecting elements 3221*a,b*.

Disclosed in FIG. 33 is an outside perspective view of a deck seam 3200 with a slide fastener 3320 behind a lower portion 3210 of the seam 3200 and no slide fastener 3320 behind an upper portion 3205 of the seam 3200 and a transition point 3240 in-between the lower portion 3210 and upper portion 3205, the portion with the slide fastener 3320 at least partially open. Also visible in FIG. 33 are connecting elements 3221*a,b*.

As described above, various other embodiments make use of a twin needle sewing machine with a support guide shaped to match but incorporating the same claimed elements. When using a twin needle sewing machine to produce a deck seam or a French seam having a slide fastener, however, it is, in various embodiments, necessary to make changes to the exact shape, size, or orientation of specific parts. For one example among others, the support guide will be attached at the front of the post bed in various embodiments and at the rear of the post bed in various other embodiments depending on what is most convenient for those building, operating, and/or servicing the sewing machine In various embodiments, the standard throat plate thickness will be of such a thickness or the spacing of the needles will be such that the thickness of the grooved throat plate of the support guide will need to be increased or the post bed lowered (or raised) or modified in shape to accommodate the grooved throat plate.

In this disclosure, the term "slide fastener" is considered a broader category within which a "zipper" would be considered an example. While the slide fastener of the present disclosure includes connecting elements made from painted metal, in various other embodiments the connecting elements are made from non-painted metal or plastic of various grades having different mechanical, chemical and other properties. In addition, many types of slide fasteners exist being what is disclosed in the aforementioned embodiments—including but not limited to flame-retardant slide fasteners, ultraviolet (UV) light-resistant slide fasteners, airtight and/or watertight slide fasteners, urethane-coated slide fasteners, and PVC-coated slide fasteners.

Also disclosed are various embodiments where the basic elements of the support guide and support guide assembly are incorporated into the original design of a sewing machine. Instead of having a separate support guide assembly, for one example among others, the front guide of the support guide and the groove of the support guide, the guide lips, and other elements of the support guide will be built into some existing part of the sewing machine such as the post in various embodiments or may include a throat plate. In this way, an operator could add a decorative topstitch to a seam containing a slide fastener without needing to modify the sewing machine they have already procured. In various embodiments, the support guide includes a throat plate and, in various embodiments, is integral with the throat plate, having a unitary body incorporating the throat plate.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A support guide for sewing a decorative topstitch on a seam with a slide fastener, the support guide comprising:

a first top surface;

a second top surface, the first top surface coplanar with the second top surface and spaced apart from the second top surface by a distance sized to accept the slide fastener;

a first planar groove side wall extending downward from the first top surface;

a second planar groove side wall extending downward from the second top surface;

a groove bottom extending from the first planar groove side wall and the second planar groove side wall; and a front guide, a top surface of the front guide flush with the groove bottom;

the first planar groove side wall, the second planar groove side wall, and the groove bottom defining a groove between the first top surface and the second top surface;

wherein the front guide is tapered, a narrow end of the front guide distal from the groove and a wider end of the front guide proximate to the groove.

2. The support guide of claim 1, wherein the front guide has a left side and a right side, the left side parallel to a centerline of the groove and the right side angled between 15 degrees and 45 degrees with respect to a centerline of the groove.

3. The support guide of claim 1, wherein the groove begins at a groove entrance and ends at a groove exit, the support guide including a guide lip adjacent to the groove entrance.

4. The support guide of claim 1, wherein the support guide includes a throat plate, a bottom surface of the groove defined in the throat plate.

5. A method of sewing a decorative topstitch on a seam with a slide fastener, the slide fastener including a first joining part including a first set of connecting elements and a second joining part including a second set of connecting elements, the method comprising:

affixing a first sewing panel to the slide fastener by affixing the first joining part of the slide fastener to a first joining edge of the first sewing panel;

affixing a second sewing panel to the slide fastener by affixing the second joining part of the slide fastener to a second joining edge of the second sewing panel;

connecting the first set of connecting elements to the second set of connecting elements thereby forming a joint seam;

placing the joint seam with the slide fastener face down on a support guide mounted on a sewing machine to align the slide fastener in a vertical position and in a horizontal position, a bottom leading edge of the first sewing panel and a bottom leading edge of the second sewing panel aligned with a first top surface and a second top surface of the support guide;

placing the joint seam with the slide fastener into a space between the first top surface and the second top surface to align the joint seam with a needle; and sewing a decorative topstitch on at least one side of the joint seam through a one of the first sewing panel or the second sewing panel, wherein the support guide includes:

the first top surface;

the second top surface, the first top surface coplanar with the second top surface and spaced apart from the second top surface by a distance sized to accept the slide fastener;

a first planar groove side wall extending downward from the first top surface;

a second planar groove side wall extending downward from the second top surface;

a groove bottom extending from the first planar groove side wall and the second planar groove side wall; and a front guide, a top surface of the front guide flush with the groove bottom;

the first planar groove side wall, the second planar groove side wall, and the groove bottom defining a groove between the first top surface and the second top surface;

wherein the front guide is tapered, a narrow end of the front guide distal from the groove and a wider end of the front guide proximate to the groove.

6. The method of claim 5, wherein the slide fastener includes a slider, and wherein the slider brings the first set of connecting elements and the second set of connecting elements includes into interlocking engagement, the first sewing panel and the second sewing panel concealing the slide fastener.

7. The method of claim 5, wherein the decorative topstitch is a deck seam.

8. The method of claim 5, wherein the decorative topstitch is a French seam.

9. A support guide for sewing a decorative topstitch on a seam with a slide fastener, the support guide comprising:

a first top surface;

a second top surface, the first top surface coplanar with the second top surface and spaced apart from the second top surface by a distance sized to accept the slide fastener;

a first planar groove side wall extending downward from the first top surface;

a second planar groove side wall extending downward from the second top surface; and a groove bottom extending from the first planar groove side wall and the second planar groove side wall;

the first planar groove side wall, the second planar groove side wall, and the groove bottom defining a groove between the first top surface and the second top surface; and a front guide, wherein the front guide is tapered, a narrow end of the front guide distal from the groove and a wider end of the front guide proximate to the groove.

10. The support guide of claim 9, wherein the front guide has a left side and a right side, the left side parallel to a centerline of the groove and the right side angled between 15 degrees and 45 degrees with respect to a centerline of the groove.

11. The support guide of claim 9, wherein the groove begins at a groove entrance and ends at a groove exit, the support guide including a guide lip adjacent to the groove entrance.

12. The support guide of claim 9, wherein the support guide includes a throat plate, a bottom surface of the groove defined in the throat plate.

13. The support guide of claim 9, wherein an edge on a right side of the front guide includes a radius.

14. The support guide of claim 13, wherein the edge is a vertical edge.

15. The support guide of claim 9, wherein an edge on a right side of the front guide includes a chamfer.

16. The support guide of claim 15, wherein the edge is a vertical edge.

17. The method of claim 5, wherein the front guide has a left side and a right side, the left side parallel to a centerline of the groove and the right side angled between 15 degrees and 45 degrees with respect to a centerline of the groove.

18. The method of claim 5, wherein the support guide is mounted to a post bed of a sewing machine.

19. The method of claim 5, wherein the groove is sized to receive connecting elements of a slide fastener.

20. The method of claim 5, wherein the groove is sized to receive a one of a deck seam and a French seam.

* * * * *